US006042064A

United States Patent [19]

Hong

[11] Patent Number: 6,042,064

[45] Date of Patent: Mar. 28, 2000

[54] WRIST SUPPORT

[76] Inventor: Kwang Y. Hong, 1666 Queen Street East, Unit 18, Toronto, Ontario, Canada, M4L 1G3

[21] Appl. No.: 09/055,241

[22] Filed: Apr. 6, 1998

Related U.S. Application Data

[60] Provisional application No. 60/057,125, Aug. 28, 1997.

[51] Int. Cl.[7] ..... B43L 15/00

[52] U.S. Cl. ..... 248/118.5; 248/118; 248/278.1; 248/918

[58] Field of Search ..... 248/118, 118.1, 248/118.3, 118.5, 278.1, 291.1, 292.13, 292.14, 918; 400/715

[56] References Cited

U.S. PATENT DOCUMENTS

| | | | |
|---|---|---|---|
| 1,516,795 | 11/1924 | Schwarting | 248/118 X |
| 5,092,552 | 3/1992 | Dayton et al. | 248/278.1 X |
| 5,158,256 | 10/1992 | Gross | 248/118.3 |
| 5,246,191 | 9/1993 | Moss | 248/118.3 |
| 5,281,001 | 1/1994 | Bergsten et al. | 248/118 X |
| 5,398,896 | 3/1995 | Terbrack | 248/118 X |
| 5,405,109 | 4/1995 | Nordnes | 248/118.3 |
| 5,597,208 | 1/1997 | Bonutti | 248/118.5 X |
| 5,722,622 | 3/1998 | Gustafson | 248/118 |
| 5,845,884 | 12/1998 | Terbrack | 248/118 |

*Primary Examiner*—Ramon O. Ramirez
*Assistant Examiner*—Gwendolyn Baxter
*Attorney, Agent, or Firm*—Ridout & Maybee

[57] ABSTRACT

A wrist support suitable for use by computer operators to reduce RSI comprises a cushion mounted from an articulated strut so as to be movable about three axes whereby it may yaw, pitch and roll relative to the strut, and a spring to bias the cushion to a neutral pitch and roll position.

8 Claims, 6 Drawing Sheets

WRIST SUPPORT

This application claims benefit of Provisional Appl. 60/057,125 filed on Aug. 28, 1997.

FIELD OF THE INVENTION

This invention relates to apparatus having a particular use in supporting the forearms and wrists of a computer keyboard operator, although it is not necessarily restricted thereto.

BACKGROUND OF INVENTION

It is well established that computer keyboard operators may be subject to repetitive strain injury (RSI) which is believed to arise from inadequate support of the wrists and forearms of the operator. Various proposals have been advanced for alleviating the problem, ranging from simple expedients such as increasing the depth of the front apron of the keyboard, to more complex expedients of an add on nature.

In the ensuing brief description and throughout the specification, reference is made to a single support unit for one wrist only, for the sake of clarity. However, it will be understood that in most instances, for keyboarding operations two such units will be employed, and that while these may be identical and physically separate, this is not necessarily the case, as they may be integrated to a greater or lesser degree into a single unit.

In other instances, a single unit may be all that is required, as might be the case where the unit is intended to provide wrist support for operating a computer mouse for an extended period of time.

U.S. Pat. No. 5,072,905 (Hyatt) describes a device with a support strut that is rotatable in a horizontal plane about a vertical axis (z axis), but which is intended to be secured in a predetermined position, and a cushion supported in a fixed manner from the support strut.

U.S. Pat. No. 5,201,485 (Moss et al) describes a device wherein a support strut is movable so as to be:

(a) freely pivotable about the Z axis;

(b) freely slidable along its length.

A cushion is supported from the distal end of the support strut so as to be freely pivotable about a yaw axis parallel to the Z axis, and in addition to pitch in a fore and aft direction relative to the longitudinal axis of the cushion. The pitch motion is controlled in part by biasing springs which bias the cushion to a neutral pitch position when an out-of-balance force is removed from the cushion.

U.S. Pat. No. 5,161,760 (Terbach) describes a device that is similar to that of Moss et al, but in addition, the support strut is freely slidable along a horizontal axis parallel to the keyboard axis.

It is also known to use as a support an articulated strut which pivots freely about its proximal end and at a point intermediate the proximal and the distal end. In accordance with one such proposal, the proximal portion of an articulated strut is formed as a hinged parallelogram which permits the height of a support cushion supported on the articulated strut to be adjusted.

SUMMARY OF INVENTION

My invention particularly relates to an improved manner in which the cushion is supported from a support strut, so as to provide:

(a) rotary movement about a yaw axis;

(b) pitching movement about a pitch axis;

(c) rolling movement about a roll axis.

The advantage of this type of mounting is that it permits a somewhat greater extension of the span of the fingers of a hand from a given position (usually the home position of the fingers) whereby it tends to avoid a more complex and more cumbersome movement of the strut portion of the units of the prior art, thereby permitting the use of simple, articulated struts.

My invention will be explained in greater detail in relation to preferred embodiments thereof, as shown in the accompanying drawings. In such embodiments, a support strut of the articulated type is shown, and while this appears to be advantageous economically, it will be appreciated that other types of support struts could equally be employed.

DESCRIPTION OF THE PREFERRED EMBODIMENT

Figure 1:
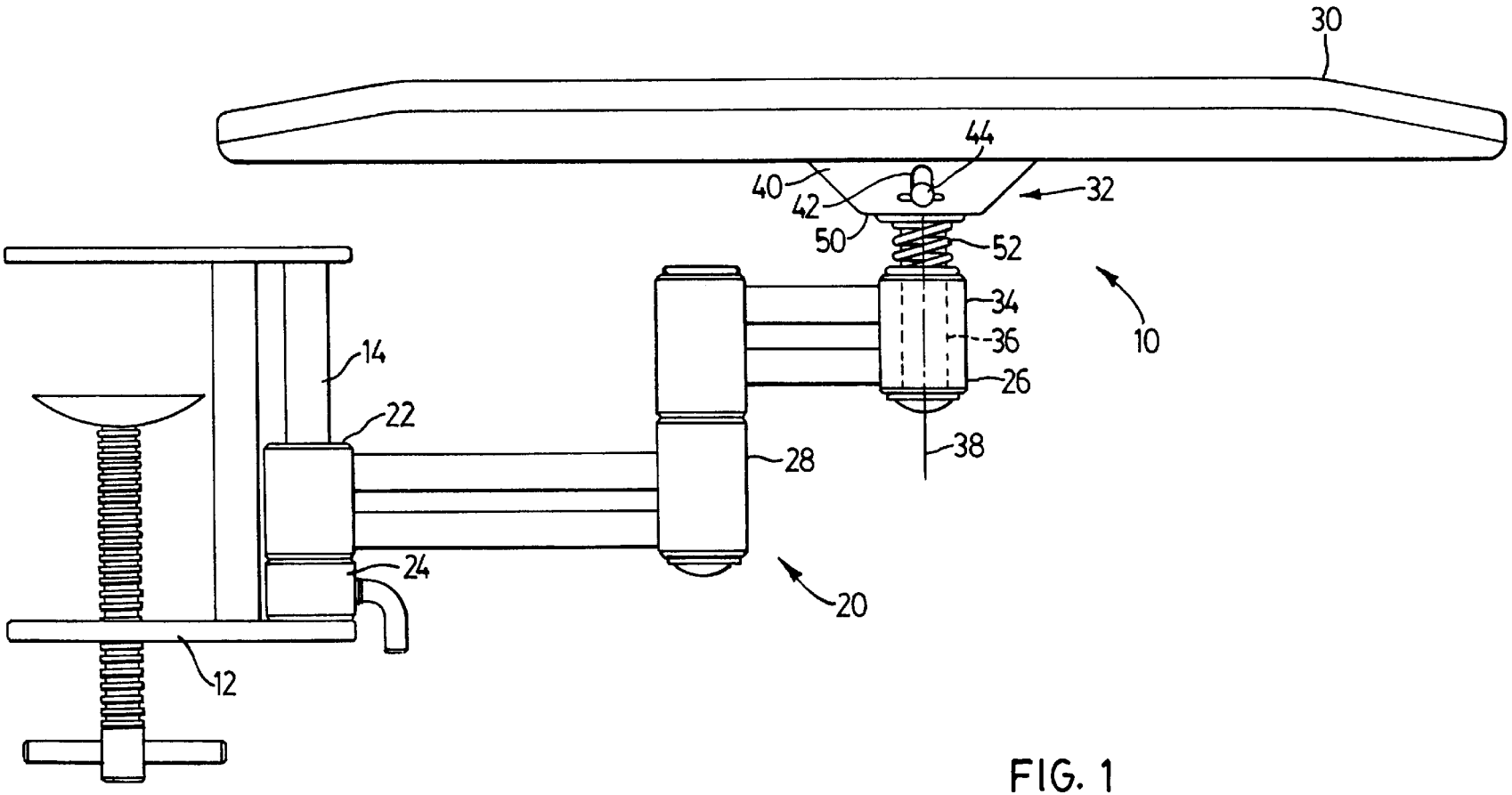
FIG. 1 shows a wrist support unit in side elevation.
Figure 2:
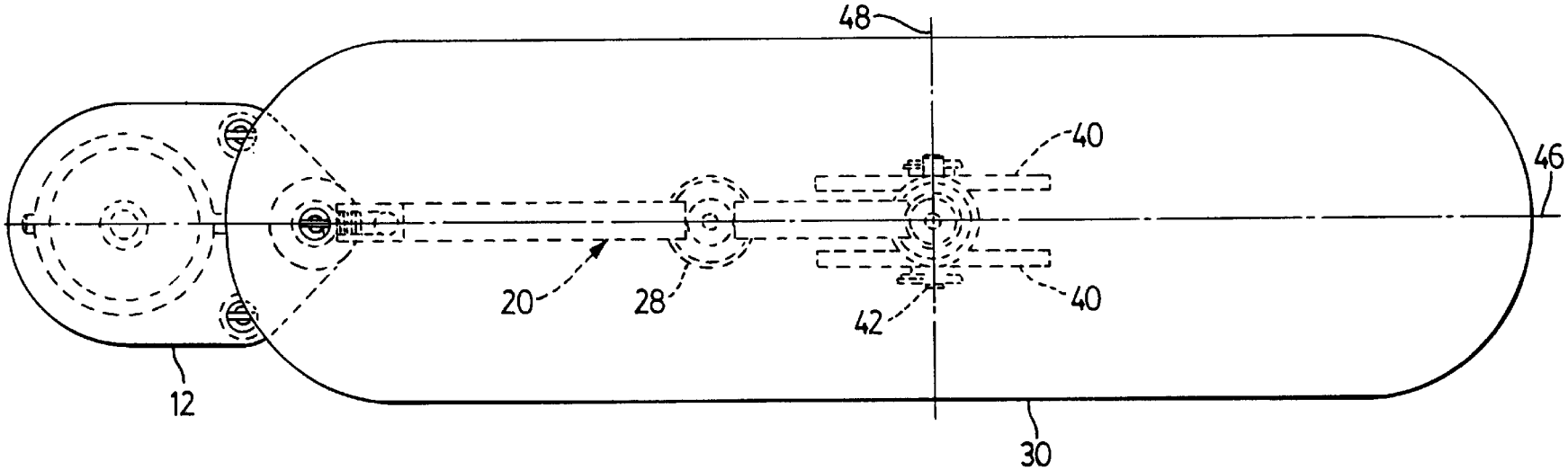
FIG. 2 shows the unit of FIG. 1 in plan view from above.
Figure 3:
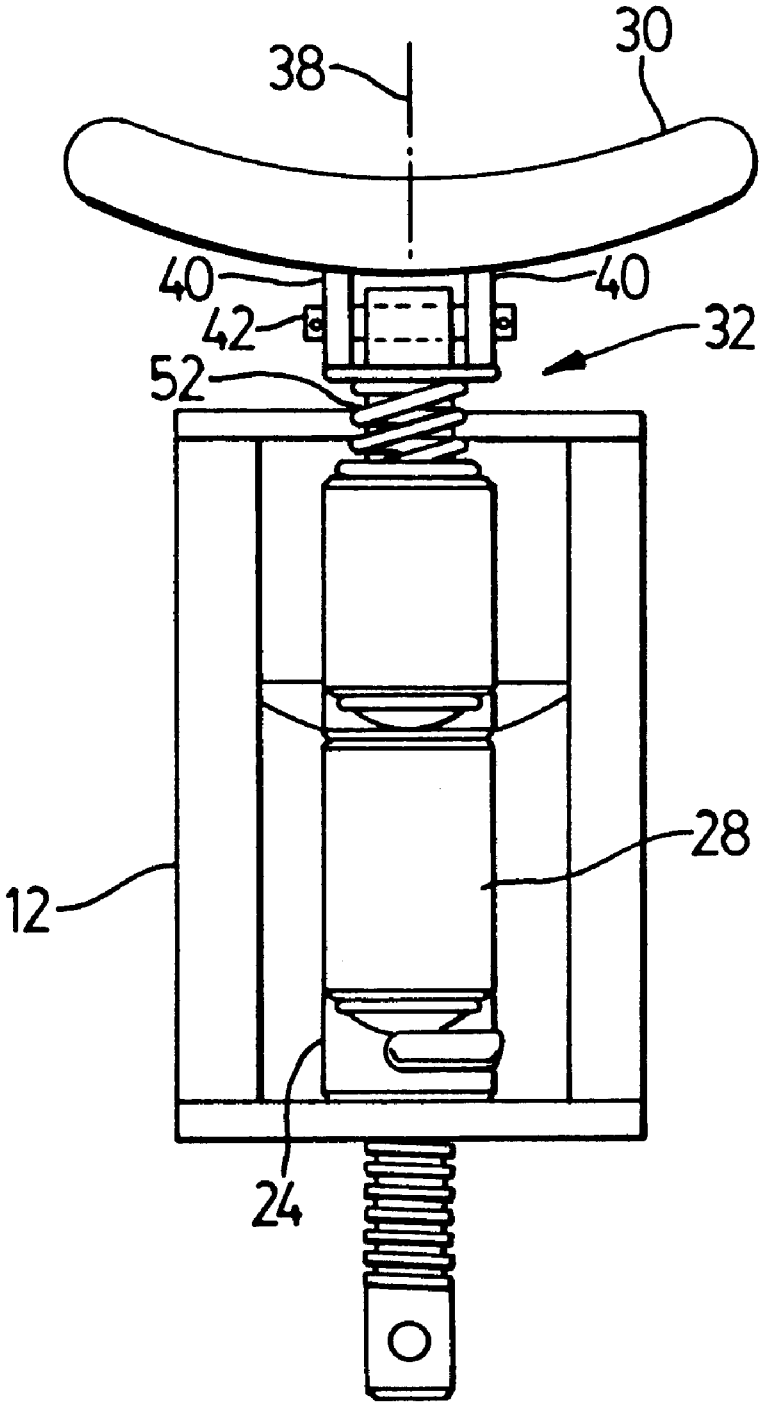
FIG. 3 shows the unit of FIG. 1 in end elevation.

Referring to the drawings in detail, a wrist support unit in accordance with my invention is identified generally by the numeral 10. Unit 10 comprises a clamp portion 12 for securing the unit to a work surface (not shown), which portion includes a pivot post 14. Generally speaking, in this first embodiment, the work surface will be in the nature of a desktop, and will be horizontal, and pivot post 14 will be vertically disposed. The terms "vertical" and "horizontal" are used in the ensuing description for convenience in a relative sense rather than in an absolute sense, and some departure therefrom may be experienced without detracting from the scope of my invention.

Unit 10 further comprises an articulated strut 20 having a proximal end 22 mounted for free pivotal movement about pivot post 14, and supported thereon by a lock collar 24 to permit the adjustment of the vertical height of strut 20 in relation to clamp portion 12. Strut 20 has a distal end 26 and an intermediate hinged portion 28. A cushion assembly 30 is mounted to distal end 26 by a bearing assembly 32 including a gudgeon bearing 34 and a gudgeon pin 36 having a yaw axis 38 about which cushion assembly 30 is rotatable.

Bearing assembly 32 further comprises a pair of cheeks 40 downwardly dependent in transverse, spaced apart relationship from the underside of cushion assembly 30. Cheeks 40 are respectively provided with a vertically elongated opening 42 therethrough, and a hinge pin 44 passing through gudgeon pin 36 and openings 42 is captured between the cushion assembly 30 and the gudgeon pin. The openings 42 form a bearing for hinge pin 44 to permit the cushion assembly 30 to roll about a roll axis 46, while at the same time permitting a pitching action about pitch axis 48.

Medial portions 50 of the lower edge of cheeks 40 are flattened, and suitably reside in a plane parallel to a plane containing the roll axis 46 and the pitch axis 48 of cushion assembly 30. A coil spring 52 is captured on gudgeon pin 36, so as to bear upon the flat medial portion 50 of cheeks 40, and urge cushion assembly 30 upwardly, with hinge pin 44 forming a travel limit as it abuts the upper extremity of elongated openings 42. The stiffness of spring 52 will be selected such that cushion assembly 30 will undergo a desired pitching and rolling action under the influence of forces to which it is normally subject in use; usually the angle of pitch and roll will be limited to between about 5° to 10°, although these angles may be varied to a greater or lesser degree.

It will be understood that the attitude of cushion assembly 30 when in its upwardly biased position may be easily regulated either in a predetermined manner, such as by varying the attitude of the medial portions 50 of cheeks 40, and/or elongated openings 42, or in an adjustable manner by providing adjustment means as will be known to persons in the art. Other variations may also be apparent to persons on the art.

Figure 4:
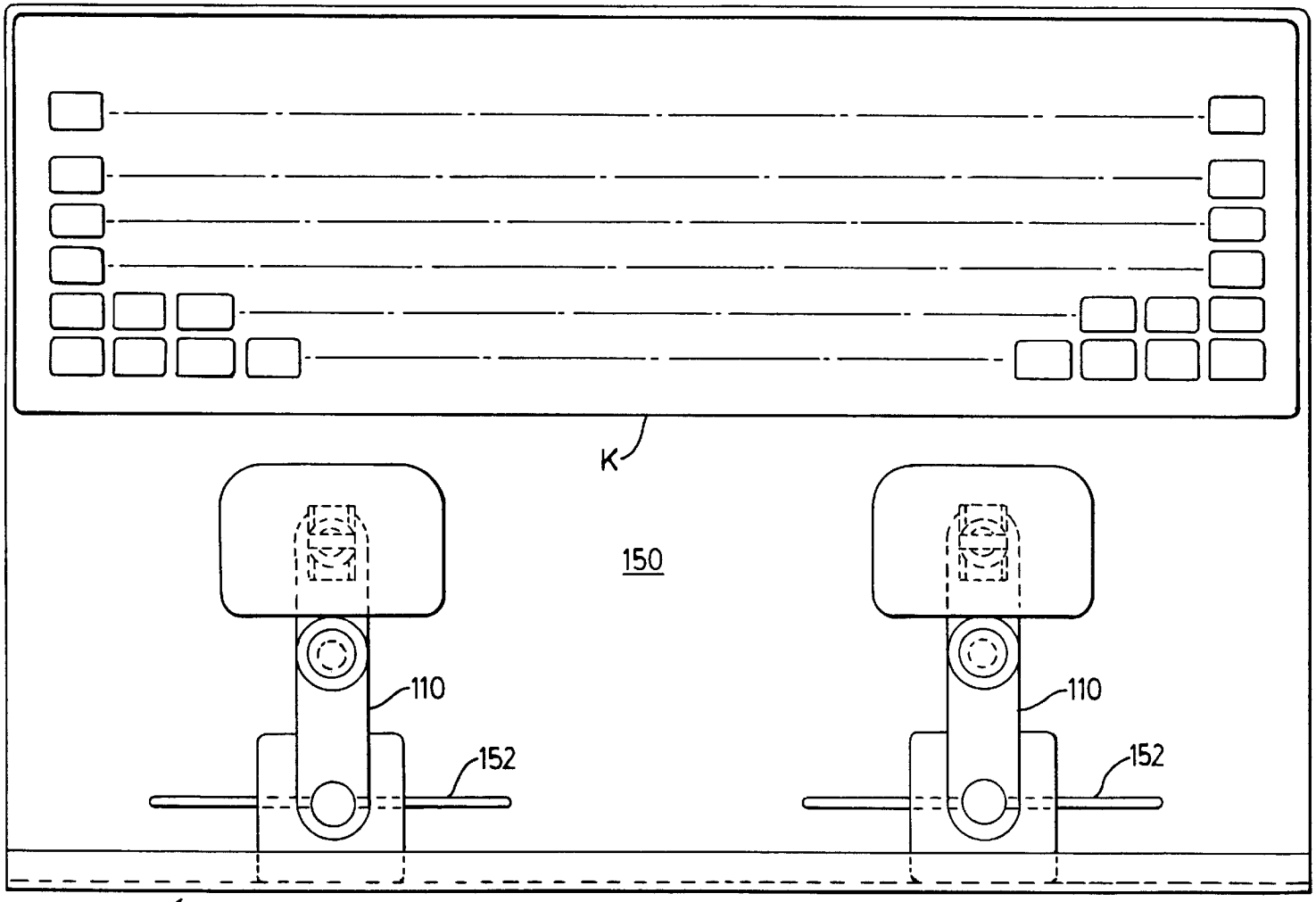
FIG. 4 is a schematic plan view of a device comprising a pair of wrist support units each of a similar nature to that shown in FIG. 1, secured to a planar sheet surface.

Referring now to FIG. 4, a wrist support device specifically adapted for use by computer keyboard operators is identified therein by the numeral 100. Device 100 comprises a pair of wrist support units 110 which are generally identical and which are similar to wrist support unit 10 described above, save in regard to the method of mounting of the unit from a support surface. In this second embodiment, wrist support unit 110 are more or less permanently attached to a thin planar sheet support 150 by any convenient means so as to be adjustably slidable along grooves 152, whereby the lateral spring between the wrist supports can be varied by a user of device 100. Planar sheet support 150 has a length, which is marginally greater than the length of a standard computer keyboard K having approximately 108 keys arranged in six banks, and a width somewhat greater than that of the keyboard, so that unit 100 may be slipped under the keyboard for use therewith.

Figure 5:
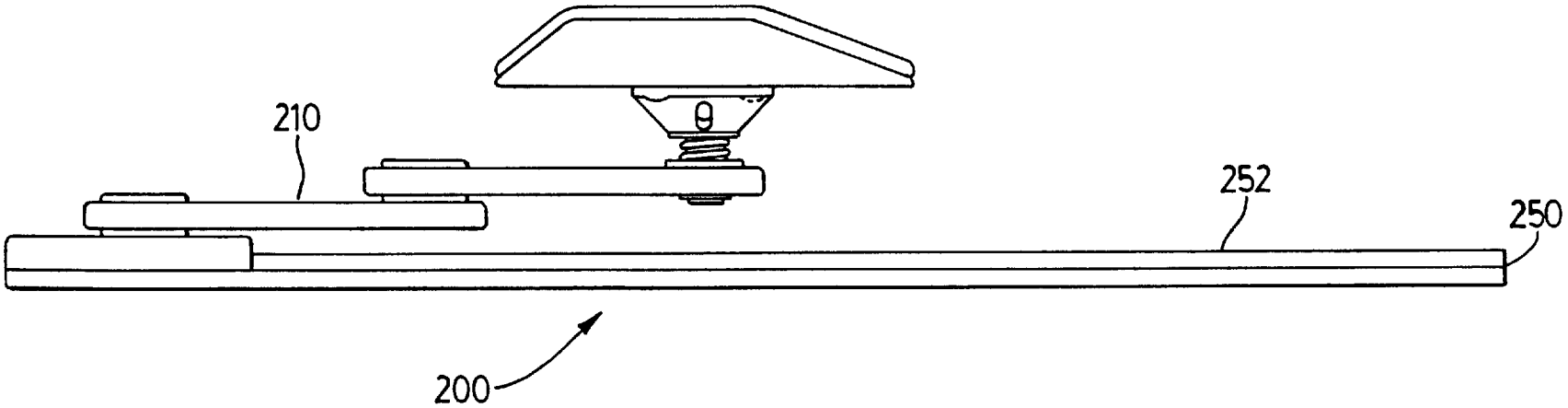
FIG. 5 is similar to FIG. 1, but shows a smaller unit secured to a mouse support.
Figure 6:
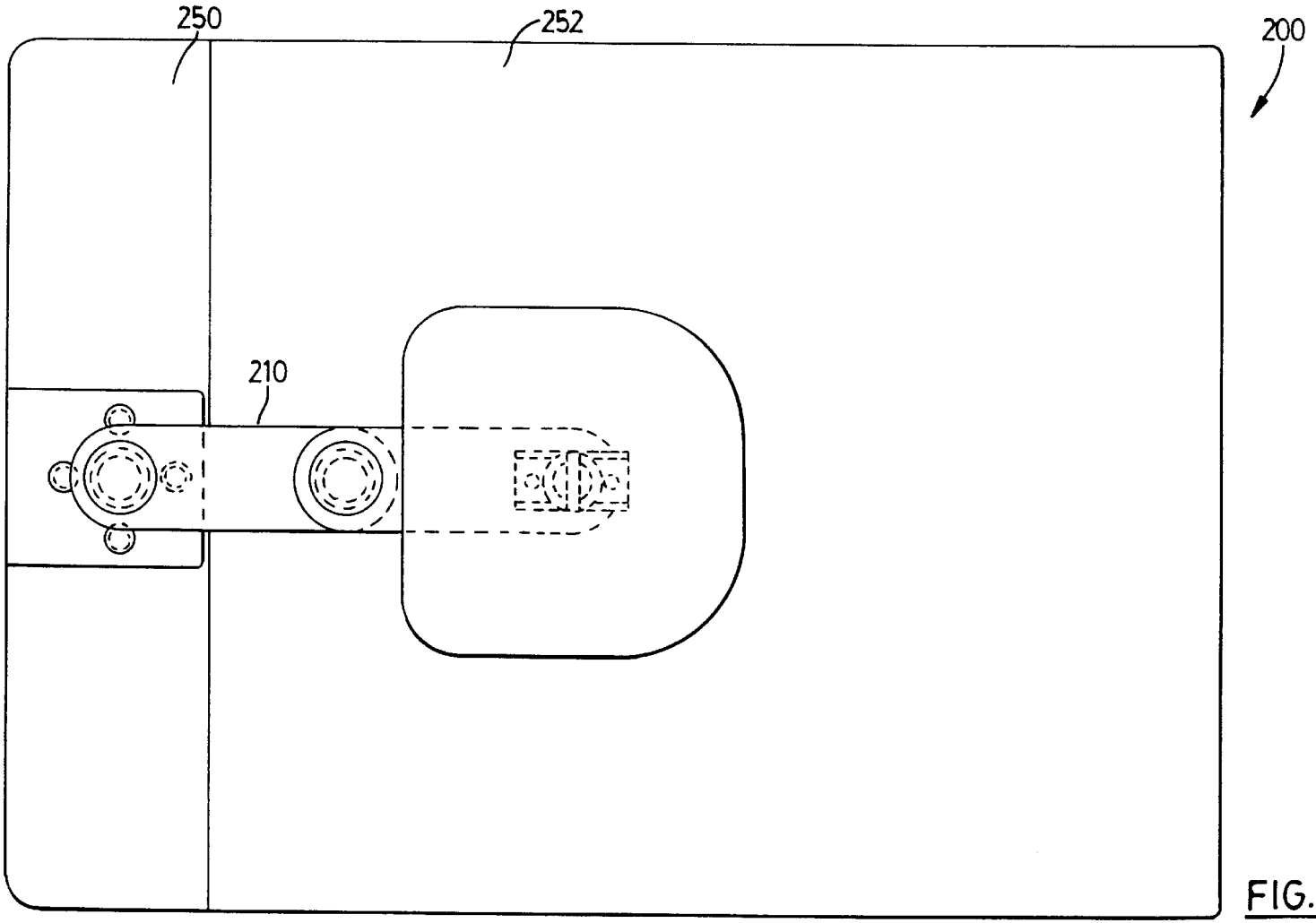
FIG. 6 shows the device of FIG. 5 in plan view from above, with hidden detail shown in dashed outline.

Referring now to FIGS. 5 and 6, this embodiment shows a wrist support device 200 particularly adapted for use with a computer mouse (not shown). Device 200 comprises a wrist support unit 210 which is similarly structured to unit 10, although somewhat smaller in physical size in view of the fact that the wrist movement of a computer operator during mouse operation is normally of a lesser reach than when using a keyboard K. Wrist support unit 210 is more or less permanently mounted from a thin planar sheet 250 having major dimensions i.e. its length and width, so as to make sheet 250 suited as a support for a mouse; commonly, it will be preferred that a resilient mouse mat 252 be positioned over mouse support 250.

It will be understood that the shaping of the upper surface of cushion assembly 30 may vary in accordance with ergonomic and comfort factors, and indeed it is not a prerequisite of my invention that this element be trough shaped in transverse cross section. It will also be understood that many other variations may be made in the arrangement of the parts within the scope of my invention as set forth in the accompanying claims.

What is claimed is:

1. A wrist support unit, the wrist support comprising a cushion assembly for supporting the wrist of a user;

a support surface;

a strut supported by said support surface;

a bearing assembly connecting said cushion assembly to said strut to permit the movement of said cushion assembly relative to said strut (a) in a rotary manner about a yaw axis, (b) in a pitching manner about a pitch axis orthogonal to the yaw axis, and (c) in a rolling manner about a roll axis orthogonal to pitch axis and the yaw axis, said bearing assembly further including a gudgeon pin upwardly depending from said strut to form said yaw axis;

a pair of cheeks downwardly depending from said cushion assembly, each cheek of said pair of cheeks having a slotted opening; and, a hinge pin captured between said gudgeon pin and said pair of cheeks, the slotted openings of the pair of cheeks forming a bearing for said hinge pin so as to provide said roll axis, said cheeks being pivotable about said hinge pin in said slotted openings to provide said pitch axis; and spring means urging said cushion assembly to a predetermined attitude relative to said yaw axis.

2. A wrist support unit as defined in claim 1 wherein said strut is articulated.

3. A wrist support unit as defined in claim 2 wherein said support surface is a mouse pad.

4. A device for reducing repetitive strain injury in computer operators comprising:

a thin planar sheet support;

at least one articulated strut having opposed ends;

pivot means securing said at least one strut adjacent one of said opposed ends to said support surface for arcuate movement thereabove;

a wrist support cushion assembly; and bearing means connecting said wrist support cushion assembly to said articulated strut adjacent the other of said opposed ends to permit said cushion assembly (a) to rotate about a first axis generally upstanding from said strut;

(b) to pitch fore and aft about a second axis;

(c) to roll from side to side about a third axis, said first, second and third axes being orthogonally related;

said bearing means further including a gudgeon pin upwardly depending from said at least one strut to form said first axis;

a pair of cheeks downwardly depending from said cushion assembly, each cheek of said pair of cheeks having a slotted opening; and, a hinge pin captured between said gudgeon pin and said pair of cheeks, the slotted openings of the pair of cheeks forming a bearing for said hinge pin so as to provide said third axis, said cheeks being pivotable about said hinge pin in said slotted openings to provide said second axis; and spring means urging said cushion assembly to a predetermined attitude relative to said first axis.

5. A device as defined in claim 4 wherein there are two said articulated struts secured to said planar sheet surface, each of said struts having a wrist support cushion secured thereto by a said bearing means.

6. A device as defined in claim 5 wherein said planar support is dimensioned to support a standard computer keyboard having approximately 108 keys.

7. A device as defined in claim 5 wherein said articulated struts are secured to said planar sheet surface in a manner so as to be adjustably movable thereon.

8. A device as defined in claim 4 wherein said planar support is a mouse support.

* * * * *